US012606763B2

(12) United States Patent
Back et al.

(10) Patent No.: US 12,606,763 B2
(45) Date of Patent: Apr. 21, 2026

(54) SAPS-FREE TWIN-TAIL AMINE DERIVATIVES ADDITIVES FOR LUBRICANT FOR FRICTION MODIFICATION AND WEAR PREVENTION

(71) Applicant: SPECIALTY OPERATIONS FRANCE, Lyons (FR)

(72) Inventors: Olivier Back, Lyons (FR); Christelle Florence Chretien, Philadelphia, PA (US)

(73) Assignee: SPECIALTY OPERATIONS FRANCE, Lyons (FR)

( * ) Notice: Subject to any disclaimer, the term of this patent is extended or adjusted under 35 U.S.C. 154(b) by 207 days.

(21) Appl. No.: 18/570,506

(22) PCT Filed: Jun. 14, 2022

(86) PCT No.: PCT/EP2022/066209

§ 371 (c)(1),
(2) Date: Dec. 14, 2023

(87) PCT Pub. No.: WO2022/263462

PCT Pub. Date: Dec. 22, 2022

(65) Prior Publication Data

US 2024/0271054 A1 Aug. 15, 2024

(30) Foreign Application Priority Data

Jun. 16, 2021 (EP) ..... 21305819

(51) Int. Cl.

| | |
|---|---|
| ***C10M 133/08*** | (2006.01) |
| ***C10M 133/16*** | (2006.01) |
| ***C10M 133/54*** | (2006.01) |
| ***C10M 133/56*** | (2006.01) |
| *C10N 30/00* | (2006.01) |
| *C10N 30/06* | (2006.01) |
| *C10N 40/04* | (2006.01) |
| *C10N 40/25* | (2006.01) |

(52) U.S. Cl.

CPC ..... *C10M 133/08* (2013.01); *C10M 133/16* (2013.01); *C10M 133/54* (2013.01); *C10M 133/56* (2013.01); *C10M 2203/1025* (2013.01); *C10M 2215/042* (2013.01); *C10M 2215/082* (2013.01); *C10N 2030/06* (2013.01); *C10N 2030/42* (2020.05); *C10N 2030/43* (2020.05); *C10N 2030/45* (2020.05); *C10N 2040/04* (2013.01); *C10N 2040/25* (2013.01)

(58) Field of Classification Search

CPC ..... C10N 2040/25; C10N 2030/06; C10N 2040/04; C10N 2030/45; C10N 2030/42; C10N 2030/43; C10N 2020/02; C10M 133/54; C10M 133/56; C10M 133/16; C10M 133/08; C10M 2215/042; C10M 2203/1025; C10M 2215/082

See application file for complete search history.

(56) References Cited

U.S. PATENT DOCUMENTS

| | | | |
|---|---|---|---|
| 3,280,029 | A | 10/1966 | Waldmann |
| 2013/0244915 | A1 | 9/2013 | DeBlase et al. |
| 2013/0274158 | A1 | 10/2013 | Woodward et al. |
| 2015/0344811 | A1 | 12/2015 | Strong et al. |
| 2019/0010418 | A1 | 1/2019 | Debord et al. |

FOREIGN PATENT DOCUMENTS

| | | | |
|---|---|---|---|
| DE | 2338087 | A1 | 1/1975 |
| EP | 2826843 | A1 | 1/2015 |
| EP | 3218340 | A1 | 9/2017 |
| FR | 3039165 | A1 | 1/2017 |
| WO | 2017174417 | A1 | 10/2017 |
| WO | 2017174424 | A1 | 10/2017 |
| WO | 20200095189 | A1 | 5/2020 |

OTHER PUBLICATIONS

Arevalo M J et al; "Optically active sugar thioamides from d-gluconolactone"; Tetrahedron Asymmetry; vol. 11; No. 9; May 2000; pp. 1985-1995; ISSN:0957-4166; DOI:10.1016/80957-4166(00)00140-3 (11 pages).

Zhang Yu et al; "Mapping the active site in a Chemzyme: Diversity in the N-Substituent in the Catalytic Asymmetric Aziridination of Imines"; Organic Letters; vol. 10; No. 23; 2008; pp. 5429-5432 (11 pages).

Ignatchenko et al; "Multiscale approach for the optimization of ketones production from carboxylic acids by the decarboxylative ketonization reaction"; Catalysis Today; Elsevier; vol. 338; 2019; pp. 3-17 (15 pages).

International Search Report issued in Application No. PCT/EP2022/066209, mailed on Sep. 26, 2022 (5 pages).

Written Opinion issued in Application No. PCT/EP2022/066209, mailed on Sep. 26, 2022 (8 pages).

*Primary Examiner* — Vishal V Vasisth

(74) *Attorney, Agent, or Firm* — Osha Bergman Watanabe & Burton LLP

(57) ABSTRACT

The present invention relates to the use as an antiwear additive (antiwear component) and friction modifier in a lubricant of at least one compound having the following formula (I) wherein: each of R and R', which are identical of different, is a aliphatic group preferably containing between 5 and 23 carbon atoms; and a and b are integers from 0 to 4; and A is a methylene group —$CH_2$—; or a carbonyl group —C(=O)—.

(I)

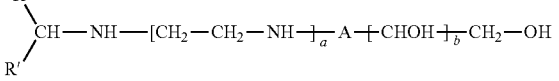

16 Claims, No Drawings

SAPS-FREE TWIN-TAIL AMINE DERIVATIVES ADDITIVES FOR LUBRICANT FOR FRICTION MODIFICATION AND WEAR PREVENTION

The present application is a U.S. national stage entry under 35 U.S.C. § 371 of International Application No. PCT/EP2022/066209 filed on Jun. 14, 2022, which claims priority to European patent application EP 21305819.1 filed on Jun. 16, 2021, the whole content of this application being incorporated herein by reference for all purposes.

The present invention relates to the field of lubricants, notably but not exclusively used in automotive applications, especially within internal combustion engines and power transmission systems such as gearboxes found in cars and trucks, for example. The invention more precisely relates to additives (also referred as components) useful in lubricant compositions, that allow to modify and reduce the wear of contacting parts (typically moving metallic parts such as gears, piston-cylinder assemblies. . . .) and to modulate the friction between these contacting parts.

Modifying the friction between moving parts is one of the fundamental roles of the lubricants. A high reduction of the friction is typically sought, for example, within internal combustion engines, especially since the friction directly impacts the fuel consumption. A reduction of the friction is also sought in transmissions systems without clutches of electrical vehicles. Thus, in a combustion engine or electrical vehicles, low coefficients of friction are sought, when for other applications, for example in gearboxes or other power transmission systems with clutches, higher friction coefficient are needed, that allow a better grip between the moving parts.

Another effect that may be ensured by a lubricant is an antiwear protection, that impacts the lifespan of the contacting parts. Whatever the coefficient of friction sought, it is highly preferable for a lubricant to provide an antiwear protection (for example for improving the durability of an internal combustion engines or of a gearbox).

Lubricant additives able to impart friction modification and antiwear properties to the lubricant are known, that includes compounds based of metal (based on zinc or molybdenum, typically) and/or on phosphorous and/or sulfur, such as dialkylthiophosphates for example, or molybdenum dithiocarbamate (MoDTC). These compounds have the drawback to lead to sulfur- or phosphorus-based residues and particles (referred as "SAPS" for: Sulphated Ash, Phosphorous and Sulfur) in the exhaust gas when the lubricant is used in a combustion (industrial or automotive) engine. And more generally, they constitute an issue for recycling the lubricant.

SAPS-free additives have been proposed that allow a friction modification, including for example fatty esters and amides, such as glycerol monooleate (GMO) or oleyl amides, for example, but these SAPS-free additive tend to have weaker antiwear properties than the aforementioned compounds based on metal, phosphorous and/or sulfur.

One aim of the invention is to provide additives for lubricants, that are free from metal, sulfur and phosphorous, and that however impart a good antiwear protection at least as good as those obtained for compounds containing metal, sulfur and phosphorous such as MoDTC. The invention further aims at providing SAPS-free additives that allow to modulate the coefficient of friction.

To this end, the instant invention provides a new family of twin tailed amine derivatives, that reveal to provide especially good antiwear properties. Each of the member of the family provide a variable impact as regards the coefficient of friction, with some members of the family leading to low coefficients of friction and other to higher coefficients, which allows to modulate the coefficient of friction depending on the application by selecting a suitable member of the family, while keeping a good antiwear protection.

More precisely, according to a first aspect, one subject-matter of the instant invention is the use as an antiwear additive in a lubricant of at least one compound having the following formula (I):

(I)

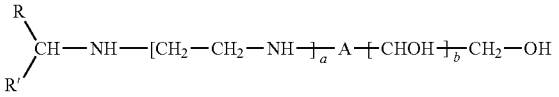

wherein:

each of R and R', which are identical of different, is an aliphatic group preferably containing between 5 and 23 carbon atoms; and a is an integer selected from 0, 1, 2, 3 and 4 and preferably a=0 or a=1; and b is an integer selected from 0, 1, 2, 3 and 4; and A is a methylene group —$CH_2$—; or a carbonyl group —C(═O)—

The instant invention also relates to the lubricant compositions comprising at least an oil and at least one compound having the following formula (I), typically as an antiwear additive (antiwear component) and/or as a friction modifier.

The oil contained in a lubricant composition according to the invention may typically include C20-C30 alkane chains. The oil may for example be selected from the base oils used in lubricants, typically:

the base oils commonly referred as oils of Group (III), which are crude oils obtained from petroleum refining, and preferably those comprising C20-C30 saturated and unsaturated hydrocarbons, including saturated alkanes (referred as paraffines) and naphtenes; and The base oils referred as oils of Group (IV), which are synthetic saturated polyalphaolefines. These oils preferably comprise C20-C30 saturated alkanes.

A lubricant composition according to the invention may further comprise, in addition to the base oil and the compound of formula (I), at least one additives selected from detergents, dispersants, anti-wears, extreme pressure agents, friction modifiers, anti-oxidants, anti-corrosion inhibitors, foam inhibitors, viscosity index improvers and pour point depressants.

The compounds of formula (I) are free from metal, sulfur and phosphorous and therefore give access to a SAPS-free technology, which is one first advantage, especially since the compounds of formula (I) do not lead to production of harmful gases when used for engine application (especially they do not induce the production of sulfated ashes produced by the burn of metals) and they are not detrimental to catalysts (as they are free from phosphorus and sulfur).

Another advantage of the compounds (I) is that they can be at least partly and preferably totally bio-based. The compounds of formula (I) may for example be prepared from a fatty internal ketone of formula (II):

(II)

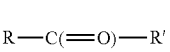

wherein each of R and R', which are identical or different (and typically identical), is as defined above, said fatty internal ketone being typically obtained through a decarboxylative ketonization reaction (Piria) of corresponding fatty acids RCOOH and R'COOH (wherein R and R' are as defined above), that may be for example bio-based, for example obtained from natural fatty esters such as those present in vegetal oils.

As an example, the compounds of formula (I) may be prepared by a direct reductive amination of the fatty internal ketone of formula (II) as defined above with an amine having the following formula (III):

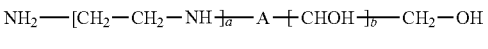

(III)

wherein a and b are as defined above.

According to another possible route, the compounds of formula (I) may be prepared by derivatization of a primary amine (IV):

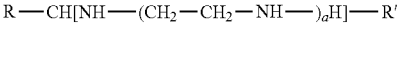

(IV)

wherein R, R' and a are as defined above. According to a specific embodiment, a=0; but a may be greater.

The primary amine (IV) is preferably obtained by a reductive amination of the aforementioned fatty internal ketone of formula (II) with an amine of formula $H_2N—(CH_2—CH_2—NH)_a—H$.

For example the compounds of formula (I) may be obtained by condensation of the primary amine (IV) with an epoxy-containing compound, such as glycidol (in this case A is $—CH_2—$ and b=1), or by reductive amination of the primary amine (IV) with an aldehyde such as glucose (in this case A is $—CH_2—$ and b=4); or by condensation of the primary amine (IV) with a gluconolactone (and then A is a carbonyl and b=4).

A first subclass of compounds of formula (I) useful according to the present invention are compounds wherein a≠0, namely a is equal to 1 or more (and typically a is equal to 1). In the compounds of formula wherein a≠0, b is typically equal to 0 and A is preferably a methylene group ($—CH_2—$). Thus, specific compounds of this first subclass are especially the 2-[(2-alkylaminoethyl)amino]ethanol derivatives having the following formula (I-1):

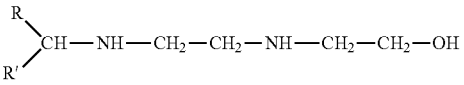

(I-1)

wherein each of R and R', which are identical of different is as defined above, and preferably contains between 5 and 23 carbon atoms.

These compounds of formula (I-1) may typically be obtained by a direct reductive amination of a fatty internal ketone of formula (II) with aminoethylethanolamine (AEEA) of formula $HO—CH_2—CH_2—NH—CH_2—CH_2—NH_2$.

Another subclass of compounds of formula (I) useful according to the invention are compounds wherein b≈0 (namely b is equal to 1, 2, 3 or 4, and typically b=1 or b=4).

In these compounds, a is typically equal to 0. Specific compounds of formula (I) wherein a=0 include the followings:

compounds of formula (I) wherein a=0; b=1 and A is a methylene group ($—CH_2—$), namely 3-alkylaminopropane-1,2-diol derivatives having the following formula (I-2):

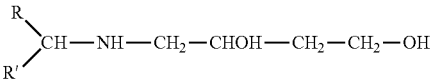

(I-2)

wherein each of R and R', which are identical of different (and typically identical), is as defined above and preferably contains between 5 and 23 carbon atoms.

The compounds of formula (I-2) may typically be obtained by a direct reductive amination of a fatty internal ketone of formula (II) with aminoglycerol $NH_2—CH_2—CHOH—CH_2OH$. Alternatively, the compounds of formula (I-2) may be synthetized by derivatizing with glycidol a primary amine $R—CH(NH_2)—R'$, said primary amine being typically obtained by a reductive amination of the aforementioned fatty internal ketone of formula (II) with ammonia.

compounds of formula (I) wherein a=0; b=4 and A is a methylene group, namely N-alkylglucamine derivatives having the following formula (I-3):

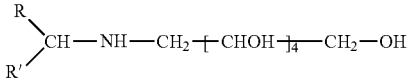

(I-3)

wherein each of R and R', which are identical of different (and typically identical), is as defined above and preferably contains between 5 and 23 carbon atoms.

The compounds of formula (I-3) may typically be obtained by a direct reductive amination of a fatty internal ketone of formula (II) with glucamine ($H_2N—CH_2—(CHOH)_4—CH_2OH$). Alternatively, the compounds of formula (I-3) may be synthetized by derivatizing with glucose a primary amine $R—CH(NH_2)—R'$, typically obtained by a reductive amination of the aforementioned fatty internal ketone of formula (II) with ammonia.

compounds of formula (I) wherein a=0; b=4 and A is a carbonyl group $—C(=O)—$ namely N-alkylgluconamide derivatives having the following formula (I-4):

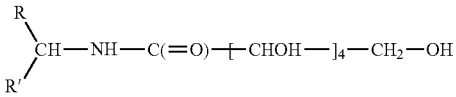

(I-4)

wherein each of R and R', which are identical of different (and typically identical), is as defined above and preferably contains between 5 and 23 carbon atoms.

The compounds of formula (I-4) may be obtained by a preparation process including a step (E) of derivatizing a primary amine $R—CH(NH_2)—R'$ with gluconolactone, wherein R and R' are as defined above. The preparation process typically include, before step (E) a preparation step (E0) of the primary amine R—CH($NH_2$)—R', by reductive amination of a fatty internal ketone of formula (II) with ammonia.

According to another aspect, a specific subject-matter of the instant invention are the compound of formula (I-4) as defined above. Another subject matter of the invention is the preparation process of these compounds.

The compounds of formula (I), and especially the compounds of formula (I-1), (I-2), (I-3) and (I-4) exhibit good antiwear properties when introduced in a lubricant composition, especially when each of R and R' contains between 5 and 23 carbon atoms. Namely, the addition of the compound in the lubricant enhances the antiwear effect of the lubricant, i.e. it decreases the mechanical wear of parts in friction when the lubricant is present between the surfaces in friction. The "antiwear" properties, as referred herein, correspond to the wear protection that can be assessed for example according to the 4 ball wear test according to ASTM D4172 standard.

Among the family of the compounds of formula (I), the compounds of formula (I-1), (I-2), (I-3) are especially useful in lubricant composition for transmission systems such as gearboxes. In addition to the good antiwear protection discussed in the previous paragraph, the compounds of formula (I-1), (I-2), (I-3) furthermore allow to obtain relatively high friction coefficients needed in transmission systems. The friction coefficient can be measured by using a High Frequency Reciprocating Rig (HFRR) as illustrated in the appended examples. The use of at least one compound (I-1), (I-2), (I-3) as an antiwear agent and friction modifier in a lubricant used in a transmission system including clutches such as a gearbox constitutes another subject-matter of the instant invention.

When at least one compound of formula (I-1) or (I-2) or (I-3) is used in a lubricant in a transmission system including clutches, such as a gearbox, both as an antiwear agent and as a friction modifier, the total content of compounds of formula (I-1) or (I-2) or (I-3) in the lubricant is preferably between 0.2 and 5% notably between 0.5 and 2% by weight based on the total weight of the lubricant composition.

Besides, the compounds of formula (I-4) are especially interesting when used as additives in engine oil. In addition to the general antiwear properties of the compounds of formula (I), that increase the service life of the engine, the compounds of formula (I-4) induce very low friction coefficients, which is of particular interest in a combustion engine (industrial or automotive) or in transmissions without clutches for electrical vehicle since it allows a reduction of energy consumption. The use of at least one compound (I-4) as an antiwear and friction reducer in a lubricant for combustion engine constitute yet another subject-matter of the instant invention.

When at least one compound of formula (I-4) is used in a lubricant in a combustion engine, both as an antiwear agent and as a friction reducer, the total content of compounds of formula (I-4) in the lubricant is between 0.2 and 5% notably between 0.5 and 2% by weight based on the total weight of the lubricant composition.

Various specific advantages and possible embodiments of the invention will now be described in more details.

Structure of the Compounds of Formula (I)

The compounds of formula (I) constitute a generic family of compounds with a so-called "twin-tailed" structure, wherein the groups R and R' correspond to the two "tails" of the structure. The two tails R and R' may be identical. Alternatively, R and R' may be distinct.

According to a preferred embodiment, each of the groups R and R' is a $C_5$-$C_{23}$ aliphatic group. Each of R and R' is linear or branched, typically linear. Besides, each of R and R' may comprise cycloaliphatic groups. The number of carbon atom in each of R and R' is preferably from 7 to 19, notably from 9 to 17, for example from 11 to 17. The number of carbon atoms of R and R' can be even or odd numbers. For example R and R' may be a, linear or branched, not cyclized or partially cyclized, aliphatic $C_7$-$C_{19}$ aliphatic group, notably a linear and not cyclized aliphatic $C_9$-$C_{15}$ group.

Groups R and R' having a number of carbon atoms or 5 or more, for example of 7 or more, notably of 9 or more and for example of 11 or more are especially interesting in terms of solubility—or at least of dispersibility—of the compounds of formula (I) in the lubricant wherein they are used as additives. On the contrary, the compounds of formula (I) carrying R and R' groups with a lower number of carbon atoms (for example when R and R' are methyl, ethyl or propyl groups or, more generally, when the total number of carbon atoms in R plus in R' is below 10) exhibit a well lower solubility.

Especially, the higher the number of carbon atoms in R and R' and the better the solubility in group 3 oils used in oils for combustion engines, with a good solubility when R and R' contain at least 5, more preferably at least 7 and even more preferably more than 9 carbon atoms, for example 11 carbon atoms or more.

This is a great advantage of the invention when Groups R and R' have a high number of carbon, preferably in the above recited ranges, since the invention allows then to make use of compounds (I) in a lubricant without the need of any co-additives such as surfactants. In addition to a direct impact on the costs and complexity of the obtained compositions, this possibility of precluding co-additives avoids any potential negative interactions with the composition and related toxicity issues.

According to an especially interesting embodiment of the invention, each of the groups R and R' is a $C_5$-$C_{23}$ aliphatic group (with a number of carbon preferably in the above recited preferred ranges) and the compound (I) is specifically used without any surfactant and, preferably, without any additive for improving the dispersibility or the solubility of said compounds (I) in the lubricant.

Besides the groups R and R' have a number of carbon atoms preferably of 23 or less, for example of 19 or less, notably of 17 or less. In the scope of the instant invention, the inventors have found that it notably leads to a proper adhesion to the surfaces to be protected by the lubricant.

The R and R' groups are preferably free from —C═C— double bond and —C≡C— triple bond —, but according to specific embodiments, R and R' may comprise at least one —C═C— double bond.

Advantageously, each of the R and R' groups is selected from alkyl groups, alkenyl groups, alkanedienyl groups, alkanetrienyl groups and alkylnyl groups. Preferably, R and R' are independently chosen from alkyl and alkenyl groups, preferably linear and not cyclized. R and R' may for example be independently selected from linear and not cyclized $C_5$-$C_{23}$ alkyl and linear and not cyclized $C_5$-$C_{23}$ alkenyl groups, for example from linear and not cyclized $C_{11}$-$C_{17}$ alkyl groups.

The R and R' groups present in the compounds of formula (I) are typically the R and R' group of a fatty internal ketone of formula (II) as defined above, which is itself advantageously obtained from a decarboxylative ketonization reaction of corresponding fatty acids RCOOH and R'COOH. These fatty acids RCOOH and R'COOH may typically be selected from caprylic acid, capric acid, lauric acid, myristic acid, palmitic acid, palmitoleic acid, stearic acid, isostearic acids, oleic acid, linoleic acid, linolenic acid, arachidic acid, behenic acid, lignoceric acid, cerotic acid or mixtures thereof. The internal ketone of formula (II) may be a symmetric internal ketone obtained from only one fatty acid (in that case, R and R' are identical and RCOOH═R'COOH). Alternatively, the internal ketone of formula (II) is asymmetric (R≠R') if obtained from two distinct fatty acids. Preferably the starting fatty acids RCOOH and R'COOH are used in the form of a mixture is, typically in the form of the so-called cuts which are obtained from vegetable or animal oils through saponification or alcoholysis. For example, the fatty acids cut is derived from coconut oil or palm kernel oil and contains a mixture of fatty acids which can comprise fatty acids having 8 carbon atoms up to 18 carbon atoms. In the case the internal ketone (II) is obtained from a cut of fatty acids R—$CO_2H$, all the possible ketones R—(C═O)—R obtained by combination of the R groups of the starting fatty acids are formed.

Alternatively, the compounds of formula (I) may be obtained from an internal ketone (II) derived from so called naphthenic acids. The term "naphthenic acid" generally denotes a mixture of cyclopentyl and cyclohexyl carboxylic acids with a carbon backbone of usually 9 to 20 carbon atoms. Naphthenic acids are obtained by oxidation of the naphtha fraction of crude oil and their composition varies with the crude oil composition and the conditions during refining and oxidation.

Preparation of the Compounds of Formula (I)

The compounds of formula (I) are typically obtained from a fatty internal ketone of formula (II) as defined above.

According to a first variant, suitable notably for preparing the compounds (I-1), (I-2) and (I-3), the preparation process of the compounds of formula (I) includes a direct reductive amination of the fatty internal ketone of formula (II) as defined above with an amine of formula (III) as defined above.

This amination may be performed by reacting the ketone (II) and the amine (III) in the presence of a metal transition (e.g. Ni, Co, Cu, Fe, Rh, Ru, Ir, Pd, Pt) based catalyst (typically Pt/C or Pd/C or Raney Ni), in a autoclave under hydrogen pressure (typically from 1 atm to 200 bar).

The amination reaction may alternatively be performed by reacting the ketone (II) and the amine (III) in the presence of titanium tetraalkoxide such as titanium tetraethoxide $Ti(OEt)_4$ or titanium tetraisopropoxide $Ti(OiPr)_4$ and then contacting the resulting reaction mixture with $NaBH_4$ or another hydride source.

The amination reaction may optionally be carried out in a solvent. However, the presence of such a solvent is not compulsory and according to a specific embodiment, no solvent is used for this step. The exact nature of the solvent, if any, may be determined by the skilled person. Typical suitable solvents include, without limitation, methanol (MeOH), ethanol, isopropanol, tert-butanol, n-butanol, tetrahydrofuran (referred as "THF"), 2-methyltetrahydrofuran (referred as "2-methyl THF"), 1,4-dioxane, dimethoxyethane, trichlooromethane, diglyme and mixtures thereof.

Besides, the amination is usually carried out at a temperature ranging from 15° C. to 400° C. and may be conducted batchwise, semi-continuously or continuously and generally performed either in a batch mode or in a continuous mode using a fixed-bed catalyst (gas-solid or gas-liquid-solid process).

According to a second variant, suitable notably for preparing the compounds (I-2), (I-3) and (I-4), may be prepared by derivatization of a primary amine (IV) as defined above, by condensation of the primary amine (IV) with an epoxy-containing compound, such as glycidol, or by reductive amination of the primary amine (IV) with an aldehyde such as glucose; or by condensation of the primary amine (IV) with a gluconolactone.

In that case, the primary amine (IV) is preferably obtained by a reductive amination of a fatty internal ketone of formula (II) with ammonia $NH_3$.

The following examples illustrate the invention.

EXAMPLES

Example 1

Synthesis of a Compound C1 of the Subclass (I-1)

A compound C1 having the following formula was synthetized according to the protocol described below, from 12-tricosanone which is an internal ketone of formula (II) wherein R═R'═—$(CH_2)_{10}$—$CH_3$

C1

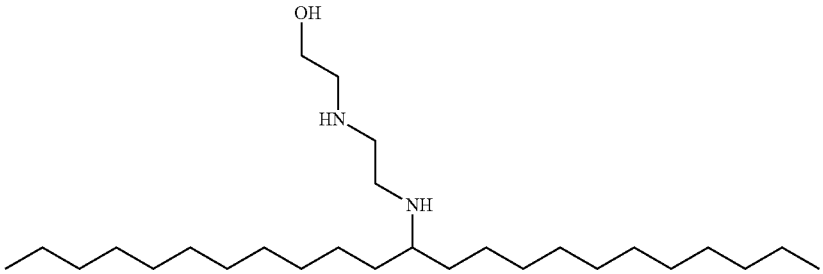

In a 2L double-jacketed reactor equipped with a mechanical stirrer (propeller with four inclined plows), a condenser and a temperature probe were added:

100 g of 12-tricosanone (0.295 mole, 1 eq.)

1 L of THE 61.5 g of aminoethylethanolamine AEEA (0.590 mole, 2 eq)

The mixture was allowed to stir at room temperature (25° C.) and 100.75 g of titanium tetraisopropoxide (0.354 mole, 1.2 eq.) was added.

The mixture was then allowed to stir at room temperature overnight and then 500 mL of methanol was added followed by the progressive and careful addition of 11.15 g of $NaBH_4$ (0.295 mole, 1 eq.).

The mixture is then stirred at room temperature for 3 hours. 1 L of water is then added (precipitation of $TiO_2$ observed) followed by the addition of 1 L of diethyl ether.

The suspension was then filtered to remove solid $TiO_2$ and the organic phase was separated from the filtrate.

The organic phase was washed 3 times with 200 mL of an aqueous NaOH solution (0.5 M), 1 time with 200 ml of water, dried over $MgSO_4$, filtered and evaporated to afford a pale yellow oil.

150 mL of methanol was then added to the crude oil in order to precipitate the insoluble alcohol by-product which is filtered out.

After methanol evaporation 105.7 g of product is obtained as a pale yellow oil.

Yield: 84%

$^1$H NMR (MeOD. 400 MHZ) δ (ppm): 3.65 (t, J=5.6 Hz, 2H), 2.77-2.60 (m, 6H), 2.49 (quint, J=5.6 Hz, 1H), 1.52-1.19 (m, 40H), 0.91 (t, J=6.8 Hz, 6H).

$^{13}$C NMR ($CDCl_3$, 101 MHZ) δ (ppm): 61.04, 57.77, 51.46, 49.66, 46.67, 34.29, 32.07, 30.13, 29.82, 29.80, 29.50, 25.95, 22.83, 14.23 (terminal $CH_3$).

Example 2

Synthesis of a Compound C2 of the Subclass (I-2)

A compound C2 having the following formula was synthetized according to the protocol described below, from 12-tricosanone which is an internal ketone of formula (II) wherein R═R'═—$(CH_2)_{10}$—$CH_3$

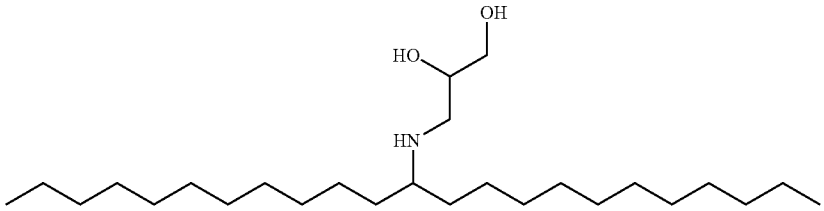

C2

The reaction was conducted in carefully dried vessels and under an inert argon atmosphere.

Fresh commercial anhydrous THF and MeOH were used as such.

In a 1 L double-jacketed reactor equipped with a mechanical stirrer (propeller with four inclined plows), a condenser and a temperature probe were added:

70 g of tricosan-12-one (207 mmol, 1 eq)

315 ml of anhydrous THF 38.8 g of 3-Amino-1,2-propanediol (222 mmol, 2 eq)

89.12 ml of titanium tetraethoxide (413 mmol, 2 eq).

The milky heterogeneous mixture was stirred at 65° C. at which temperature and turned homogeneous transparent orange. It was allowed to stir at this temperature overnight. The obtained mixture was then cooled down to 40° C. and anhydrous methanol (63 ml) is added into the reactor followed by careful addition of 16.3 g of $NaBH_4$ (413 mmol, 2 eq) portion wise while monitoring foaming during the addition. The mixture was then stirred at 40° C. for 3 hours.

After 3 h, $^1$H NMR analysis in MeOD (sampling 2-3 drops from the mixture, addition of water and diethyl ether, filtration of formed $TiO_2$ on celite, solvent evaporation and MeOD addition) showed the formation of the expected product.

The reaction mixture was allowed to cool down to room temperature and water (200 ml) was added slowly to quench $NaBH_4$ excess followed by 200 ml of diethyl ether.

The mixture was filtered on celite to remove the large amount of $TiO_2$ and the solid was washed several times with diethyl ether. The filtrate was decanted and the organic phase was washed 3 times with water and 1 time with brine. The organic phase was dried over $MgSO_4$, filtered and evaporated to afford crude product as a yellow oil which crystallizes at room temperature.

The product was then purified thanks to flash chromatography on silica gel using $CHCl_3$:/PrOH eluent with a gradient going from 100% chloroform to 60/40 $CHCl_3$:iPrOH (30 ml/min) followed by elution with isopropanol (150 ml/min).

After solvent evaporation 40.05 g of product analytically pure was obtained in the form of a clear oil which crystallizes as a white solid at room temperature.

Yield: 47%.

$^1$H NMR (MeOD. 400 MHZ) δ (ppm): 3.75-3.67 (m, 1H), 3.57-3.46 (m, 2H), 2.67 (dd, J=12.0 Hz, J=3.7 Hz, 1H), 2.55-2.45 (m, 2H), 1.53-1.39 (m, 4H), 1.39-1.24 (m, 36H), 0.9 (t, J=6.8 Hz, 6H).

$^{13}$C NMR (MeOD, 101 MHZ) δ (ppm): 71.81, 66.47, 59.03, 51.1, 34.75, 33.25, 31.12, 31.09, 30.94, 30.87, 30.84, 30.65, 26.91, 23.91, 14.62 (terminal $CH_3$).

Example 3

Synthesis of a Compound C3 of the Subclass (I-2)

A compound C3 having the following formula was synthetized according to the protocol described below, from 16-hentriacontanone which is an internal ketone of formula (II) wherein R═R'═—$(CH_2)_{14}$—$CH_3$

C3

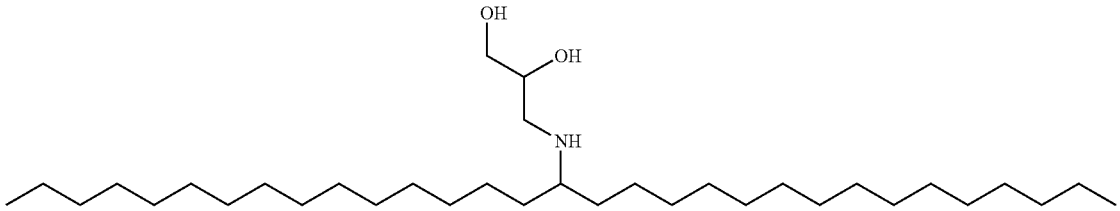

The reaction was conducted under an inert argon atmosphere.

In a 1 L double-jacketed reactor equipped with a mechanical stirrer (propeller with four inclined plows), a condenser and a temperature probe were added:

50 g of 16-hentriacontanone (111 mmoles, 1 eq.)

281 mL of $CHCl_3$ 17.73 mL of 3-amino-1,2-propanediol (20.8 g, 222 mmoles, 2 eq.)

The mixture was then stirred at room temperature and 54.71 mL of $Ti(OEt)_4$ (59.52 g, 222 mmoles, 2 eq.) was added into the reactor.

The mixture is then stirred at 65° C. overnight and it was observed that during the course of the reaction the mixture becomes homogeneous.

At the end of the reaction, the temperature was cooled down at 40° C. and 56 mL of anhydrous methanol was added into the reactor followed by the careful and slow addition of 8.74 g of $NaBH_4$ (222 moles, 2 eq.). Care should be taken as foaming can occur during $NaBH_4$ addition.

The reaction medium was then stirred at 40° C. for 3 h00.

Then the mixture was cooled down at room temperature and 100 ml of water was added followed by 100 mL of diethyl ether. During water addition precipitation of $TiO_2$ occurred. The suspension was filtered, the solid was washed several times with diethyl ether and the biphasic filtrate was separated. The organic phase was again filtered over celite and was washed with water and brine. The organic phase was then dried over $MgSO_4$, filtered and evaporated to afford the crude material as a yellow paste (48.9 g).

The crude was then purified through flash chromatography over silica gel using $CHCl_3$:isopropanol mixture as the eluent with a gradient going from 100:0 to 50:50. After solvent evaporation 28.75 g of pure product is obtained (54.70 mmoles)

Yield: 49%

$^1$H NMR (MeOD, 400 MHZ) δ (ppm): 3.78-3.64 (m, 1H), 3.62-3.42 (m, 2H), 2.78 (dd, J=11.6 Hz, J=3.6 Hz, 1H), 2.62-2.40 (m, 2H), 1.70-1.11 (m, 56H), 0.90 (t, J=6.4 Hz, 6H).

$^{13}$C NMR (MeOD, 101 MHZ) δ (ppm): 71.78, 66.46, 59.03, 51.08, 34.67, 33.26, 31.08, 31.04, 30.97, 30.95, 30.92, 30.83, 30.80, 30.66, 26.87, 26.85, 23.91, 14.62 (terminal $CH_3$).

Example 4

Synthesis of a Compound C4 of the Subclass (I-2)

A compound C4 having the following formula was synthetized according to the protocol described below, from 18-pentatriacontanone which is an internal ketone of formula (II) wherein R═R'═—$(CH_2)_{16}$—$CH_3$

C4

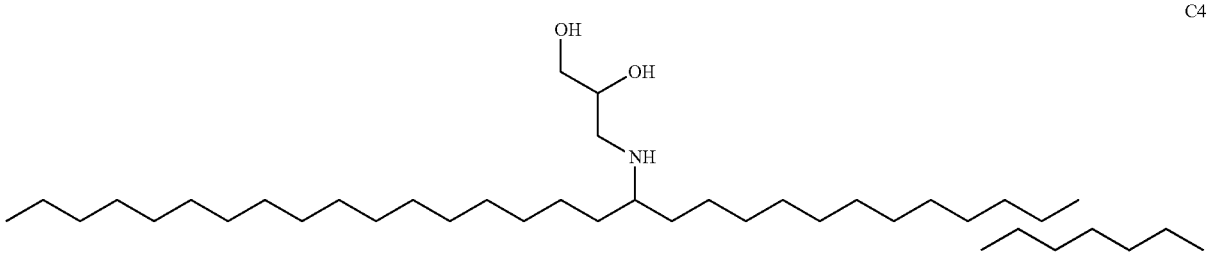

The reaction was conducted under an inert argon atmosphere.

A solution of pentatriacontan-18-one (100 g, 0.197 mole, 1 eq.) in 2-Methyl THF (471 mL) was prepared in a 1 L double-jacketed reactor equipped with a mechanical stirrer (propeller with four inclined plows) a condenser and a temperature probe.

To this solution were added under stirring:

37.06 g of (±)-3-Amino-1,2-propanediol (0.395 mole, 2 eq.)

105.87 g of titanium (IV) ethoxide (0.395 mole, 2 eq.).

The solution was refluxed at 80° C. for 24 h and kept at 50° C. overnight under stirring. The reaction mixture was then diluted with MeOH (94 mL), followed by addition of $NaBH_4$ portion wise (15.55 g, 0.395 mole, 2 eq.) and stirred at 50° C. for 5 h.

The reaction mixture was further stirred at room temperature over the weekend. The reaction mixture was then quenched with 200 ml of water and the resulting mixture was concentrated under reduced pressure to remove 2-Me THF and methanol. To the residue was added toluene (200 mL) and the mixture was concentrated under vacuum to remove toluene-water azeotrope.

The resulting white TiO2 solid was filtered over celite and washed with large amounts of chloroform. The filtrate was washed with DI water and brine solution.

The combined organic phase was concentrated under reduced pressure and dried. The crude was then purified by flash chromatography over silica gel to yield 30 g of pure product (0.056 mole).

Yield: 26%

$^{1}$H NMR ($CDCl_3$, 400 MHZ) δ (ppm): 3.74-3.64 (m, 2H), 3.60 (dd, J=10.4 Hz, J=3.6 Hz, 1H), 2.83 (dd, J=12.4 Hz, J=3.6 Hz, 1H), 2.61 (dd, J=12.4 Hz, J=6.4 Hz, 1H), 2.43 (quint, J=1 Hz, 1H), 1.45-1.15 (m, 64H), 0.86 (t, J=6.8 Hz, 6H).

$^{13}$C NMR ($CDCl_3$, 101 MHZ) δ (ppm): 69.57, 66.06, 57.68, 49.61, 34.06, 34.01, 31.96, 29.94, 29.74, 29.70, 29.40, 25.72, 22.72, 14.15 (terminal $CH_3$).

Example 5

Synthesis of a Compound C5 of the Subclass (I-4)

A compound C5 having the following formula was synthetized according to the protocol described below, from 12-tricosanone which is an internal ketone of formula (II) wherein R═R'═—$(CH_2)_{10}$—$CH_3$

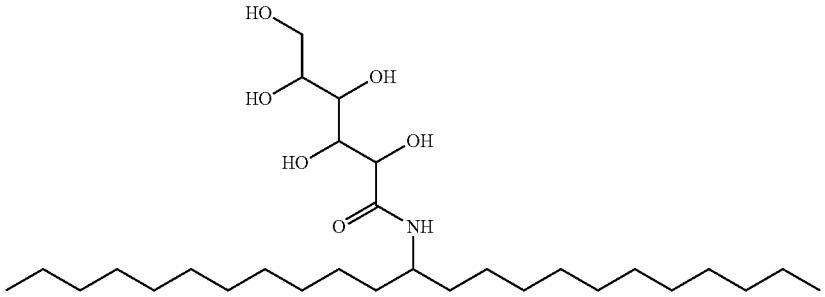

C5

All the reactions were conducted under an inert argon atmosphere.

Step 1: Reductive Amination of the Internal Ketone (Preparation of a Primary Amine of Formula (IV) Wherein Wherein R═R'═—$(CH_2)_{10}$—$CH_3$)

In a 5 L three necked round bottom flask equipped with a magnetic stirrer, a condenser, a temperature probe and a heater was prepared a solution of tricosan-12-one (100 g, 0.295 mol, 1 eq.) in 700 mL of methanol.

Then $NH_4OAc$ (227.386 g, 2.95 mol, 10 eq.) followed by $NaCNBH_3$ (74.15 g, 1.18 mol, 4 eq.) are added into the mixture in small portions. The reaction media was stirred at room temperature for 1 hour. Finally, the mixture was heated under reflux for 16 hours. Then the reaction media was cooled down to room temperature and concentrated under vacuum. Finally, 500 mL of a saturated $NaHCO_3$ aqueous solution and 500 mL of methyl-tertbutyl ether MTBE were added to the residue and the mixture was stirred at room temperature for 1 hour. Concentrated aqueous NaOH solution was added in order to adjust the pH around 9.

The obtained product (tricosan-12-amine) was extracted with MTBE and the organic phase was washed several times with water and brine. The organic phase is dried with $K_2CO_3$, filtered and concentrated in vacuum to afford 100.4 g of crude yellow oil.

The crude was then purified through flash chromatography column over silica gel using dichloromethane: methanol mixture as the eluent with a gradient going from DCM:

MeOH=100:1 to DCM: MeOH=10: 1+1% $Et_3N$. After solvent evaporation 93.5 g (0.275 mol) of pure light yellow oil was obtained.

Yield: 93%

Step 2: Condensation with δ-gluconolactone

The reaction is conducted under an inert argon atmosphere.

In a 250 mL round bottom flask equipped with a condenser, a magnetic stirrer, a heater and a temperature probe were added:

30 g of tricosan-12-amine as obtained in step 1 (88.3 mmoles, 1 eq.)

31.47 g of δ-gluconolactone (176.7 mmoles, 2 eq.)

75 mL of Me-THF

The mixture was stirred at 80° C. for 6 hours and then is allowed to cool down to room temperature.

500 mL of water was then added into the reaction mixture and the product is extracted with 3×500 mL of chloroform.

The organic phases were gathered, washed again with 500 ml of water, dried over $MgSO_4$, filtered and the solvent is evaporated to afford 47 g of a pale yellow paste.

At this stage the crude product still contained residual amounts of the starting amine, therefor the solid was washed with 3×100 mL of ethyl acetate.

The solid is then dried to remove traces of solvent and 41 g of analytically pure product (79.2 mmoles) is obtained as a white solid.

Yield: 90%

$^{1}$H NMR ($d_6$-DMSO, 400 MHZ) δ (ppm): 7.14 (d, J=9.2 Hz, 1H), 5.32 (d, J=5.2 Hz, 1H), 4.52 (d, J=5.2 Hz, 1H), 4.45 (d, J=5.2 Hz, 1H), 4.32 (d, J=7.6 Hz, 1H), 4.32 (t, J=5.6 Hz, 1H), 3.97 (dd, J=4.8 Hz, J=4.0 Hz, 1H), 3.92-3.84 (m, 1H), 3.75-3.62 (m, 1H), 3.58 (ddd, J=10.8 Hz, J=5.6 Hz, J=2.8 Hz, 1H), 3.52-3.42 (m, 2H), 3.35 (dt, J=10.8 Hz, J=5.6 Hz, 1H), 1.44-1.12 (m, 40H), 0.85 (t, J=7.2 Hz, 6H).

Example 6

Synthesis of a Compound C6 of the Subclass (I-4)

A compound C6 having the following formula was synthetized according to the protocol described below, from 16-hentriacontanone which is an internal ketone of formula (II) wherein R═R'═—$(CH_2)_{14}$—$CH_3$

C6

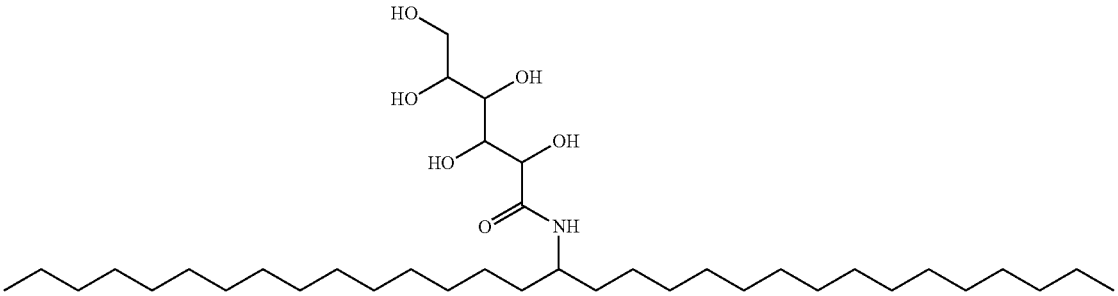

All the reactions were conducted under an inert argon atmosphere.

Step 1: Reductive Amination of the Internal Ketone (Preparation of a Primary Amine of Formula (IV) Wherein Wherein R═R'═—$(CH_2)_{14}$—$CH_3$)

Same protocol as described in step 1 of example 1 has been followed, but starting from hentriacontan-16-amine instead of tricosan-12-amine.

Step 2: Condensation with δ-gluconolactone

The reaction was conducted under an inert argon atmosphere.

In a 250 mL round bottom flask equipped with a condenser, a magnetic stirrer, a heater and a temperature probe were added:

30.0 g of hentriacontan-16-amine (66.4 mmoles, 1 eq.)

11.8 g of δ-gluconolactone (66.4 mmoles, 1 eq.)

75 mL of Me-THF

The mixture was stirred at 80° C. for 2 days and then was allowed to cool down to room temperature.

500 ml of water was then added into the reaction mixture followed by 500 mL of chloroform. The obtained precipitate is filtered out and the solid was washed with 2*100 ml of ethyl acetate.

The solid was then dried to remove traces of solvent and 32 g of analytically pure product (51 mmoles) is obtained as a white solid.

Yield: 77%

$^1$H NMR ($d_6$-DMSO:$CDCl_3$, 400 MHZ) δ (ppm): 6.87 (d, J=9.2 Hz, 1H), 5.25 (d, J=4.8 Hz, 1H), 4.46 (d, J=4.8 Hz, 1H), 4.40 (d, J=4.8 Hz, 1H), 4.24 (d, J=7.6 Hz, 1H), 4.15 (t, J=5.6 Hz, 1H), 4.05 (dd, J=4.0 Hz, J=3.2 Hz, 1H), 4.01-3.96 (m, 1H), 3.77-3.66 (m, 1H), 3.64-3.50 (m, 3H), 3.52-3.42 (m, 1H), 1.55-1.10 (m, 56H), 0.82 (t, J=6.8 Hz, 6H).

$^{13}$C NMR ($d_6$-DMSO:$CDCl_3$, 101 MHZ) δ (ppm): 171.9, 74.54, 73.60, 71.80, 70.26, 63.82, 48.57, 35.05, 31.82, 29.59, 29.55, 29.52, 29.24, 25.90, 25.86, 22.61, 14.31 (terminal $CH_3$).

Example 7

Antiwear and Friction Modifying Performances

The synthetized compounds C1-C6 have been tested according to the following protocols ("4 ball wear test" and "Friction test" defined hereinafter).

A further compound, herein referred as "compound C7", has been tested according to the same protocol for the friction test. This compound C7, purchased from Asta Tech Inc, is 3-(isopropylamino)propane-1,2-diol (CAS #6452-5-9) of formula:

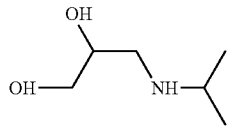

For the sake of comparison, the following additives have been tested in the same conditions:

GMO: Glycerol Monooleate

Oleyl amide

MoDTC (Molybdeneum Dithiocarbamate): 55-65% by weight of a MoDTC mixture of Molybdenum, bis [N,N-bis(2-ethylhexyl)carbamodithioato-kS, kS']dioxodi-m-thioxodi- and Molybdenum, bis(N,N-ditridecylcarbamodithioato-κS,κS')dioxodi-μ-thioxodi-, branched in a mineral oil 4 Ball Wear Test (for the Evaluation of Wear Protection) Test Made According to ASTM D4172

All the tests run for 60 min at 75° C. under a 40 kg load, at a 1200 rpm speed.

Each candidate is added at 1 wt % in a Group II mixture base oil of 45 wt % of a base oil at 6.5 cSt at 100 C and 55% of a base oil at 12 cSt at 100° C. to meet an overall kinematic viscosity at 9 cSt at 100° C.

Friction Test:

Friction has been evaluated using a HFRR (High Frequency Reciprocating Rig) under the following conditions:

slide ball on disc: metal/metal under a 200 g load at a 1000 microns stroke, at 40° C. for 15 min and then ramped to 150° C. @ 2° C./min for 55 min.

Each candidate was added at 1 wt % in a Group III base oil with a kinematic viscosity at 8cSt at 100° ° C. to mimic a typical engine oil (SAE 20).

The obtained results are reported in the following Table 1:

TABLE 1

Results

| Tested compound | Antiwear: scar diameter (mm) | Friction test: coefficient of friction @ 150° C. |
|---|---|---|
| C1 | 0.53 | 0.176 |
| C2 | 0.57 | 0.127 |
| C3 | 0.58 | 0.135 |
| C4 | 0.54 | 0.122 |
| C5 | 0.34 | 0.085 |
| C6 | 0.41 | 0.076 |
| C7 | - not tested - | 0.171 |
| GMO (COMPARATIVE) | 0.75 | 0.094 |

TABLE 1-continued

| Results | | |
|---|---|---|
| Tested compound | Antiwear: scar diameter (mm) | Friction test: coefficient of friction @ 150° C. |
| Oleyl amide (COMPARATIVE) | 0.55 | 0.105 |
| MoDTC (COMPARATIVE) | 0.42 | 0.076 |

The invention claimed is:

1. A lubricant composition comprising at least an oil and at least a compound of formula (I):

(I)

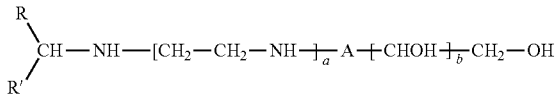

wherein:

each of R and R', which are identical or different, is an aliphatic group containing between 5 and 23 carbon atoms;

a is an integer selected from 0, 1, 2, 3 and 4;

b is an integer selected from 0, 1, 2, 3 and 4; and

A is a methylene group —$CH_2$— or a carbonyl group —C(=O)—.

2. A compound having the following formula (I-4):

(I-4)

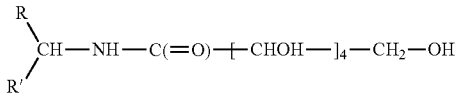

wherein each of R and R', which are identical or different, is an aliphatic group containing between 5 and 23 carbon atoms.

3. A process for preparing the compound according to claim 2, comprising a step (E) of derivatizing a primary amine R—CH($NH_2$)—R' with gluconolactone, wherein R and R' are identical or different, and are an aliphatic group.

4. The process of claim 3, which includes, before the step (E), a preparation step (E0) of the primary amine R—CH($NH_2$)—R', by a reductive amination of a fatty internal ketone of formula (II):

(II)

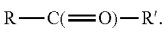

5. The process of claim 4, wherein the fatty internal ketone (II) is obtained through a decarboxylative ketonization of two fatty acids RCOOH and R'COOH.

6. The process of claim 5, wherein the fatty acids RCOOH and R'COOH are bio-based.

7. The lubricant composition of claim 1, wherein a=0 or a=1.

8. The lubricant composition of claim 1, wherein the compound of formula (I) is a 2-[(2-alkylaminoethyl)amino] ethanol derivative having the following formula (I-1):

(I-1)

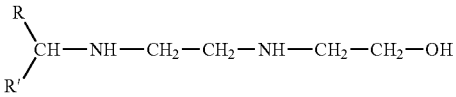

wherein each of R and R', which are identical or different, is an aliphatic group containing between 5 and 23 carbon atoms.

9. The lubricant composition of claim 1, wherein the compound of formula (I) is a 3-alkylaminopropane-1,2-diol derivative having the following formula (I-2):

(I-2)

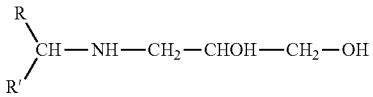

wherein each of R and R', which are identical or different, is an aliphatic group containing between 5 and 23 carbon atoms.

10. The lubricant composition of claim 1, wherein the compound of formula (I) is a N-alkylglucamine derivative having the following formula (I-3):

(I-3)

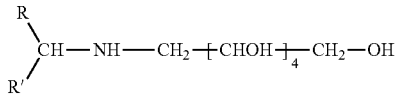

wherein each of R and R', which are identical or different, is an aliphatic group containing between 5 and 23 carbon atoms.

11. The lubricant composition of claim 1, wherein the compound of formula (I) is a N-alkylgluconamide derivative having the following formula (I-4):

(I-4)

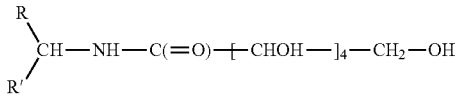

wherein each of R and R', which are identical or different, contain between 5 and 23 carbon atoms.

12. The lubricant composition of claim 1, wherein the compound of formula (I) is both an antiwear agent and a friction modifier.

13. The lubricant composition of claim 1, wherein a total content of the at least one compound of formula (I) is between 0.2 and 5% by weight, based on a total weight of the lubricant composition.

14. The lubricant composition of claim 11, wherein the compound of formula (I-4) is both an antiwear agent and a friction reducer in a combustion engine or in transmissions without clutches for electrical vehicles.

15. The lubricant composition of claim 14, wherein a total content of the compound of formula (I-4) is between 0.2 and 5% by weight based on a total weight of the lubricant composition.

16. The process of claim 15, wherein the fatty acids RCOOH and R'COOH are obtained from natural fatty esters.

* * * * *